US006899087B2

(12) United States Patent
Norgauer

(10) Patent No.: US 6,899,087 B2
(45) Date of Patent: May 31, 2005

(54) COMPENSATING ELEMENT FOR A FUEL INJECTOR VALVE

(75) Inventor: Rainer Norgauer, Ludwigsburg (DE)

(73) Assignee: Robert Bosch GmbH, Stuttgart (DE)

( * ) Notice: Subject to any disclaimer, the term of this patent is extended or adjusted under 35 U.S.C. 154(b) by 10 days.

(21) Appl. No.: 10/344,311

(22) PCT Filed: Aug. 3, 2001

(86) PCT No.: PCT/DE01/02967

§ 371 (c)(1),
(2), (4) Date: Jul. 24, 2003

(87) PCT Pub. No.: WO02/12718

PCT Pub. Date: Feb. 14, 2002

(65) Prior Publication Data

US 2004/0020470 A1 Feb. 5, 2004

(30) Foreign Application Priority Data

Aug. 9, 2000 (DE) ..... 100 38 763

(51) Int. Cl.[7] ..... F02M 55/02
(52) U.S. Cl. ..... 123/470; 123/467
(58) Field of Search ..... 123/470, 467

(56) References Cited

U.S. PATENT DOCUMENTS 2,100,366 A 11/1937 Tyler
6,263,863 B1 * 7/2001 Giovannini et al. ..... 123/470
6,481,421 B1 * 11/2002 Reiter ..... 123/470
6,684,861 B2 * 2/2004 Reiter ..... 123/470

FOREIGN PATENT DOCUMENTS

| | | |
|---|---|---|
| DE | 197 35 665 | 1/1999 |
| DE | 197 43 103 | 4/1999 |
| EP | 0 636 820 | 2/1995 |
| EP | 0 969 203 | 1/2000 |
| JP | 6-10794 | 1/1984 |
| JP | 11-210885 | 8/1999 |
| JP | 11-210886 | 8/1999 |

OTHER PUBLICATIONS

Patent Abstracts of Japan, vol. 018, No. 212 (M–1593), Apr. 15, 1994.
Patent Abstracts of Japan, vol. 1999, No. 13, Nov. 30, 1999.

* cited by examiner

*Primary Examiner*—Mahmoud Gimie
(74) *Attorney, Agent, or Firm*—Kenyon & Kenyon

(57) ABSTRACT

A compensating element for a fuel injector, insertable into a receiving bore of a cylinder head of an internal combustion engine, for the direct injection of fuel into the combustion chamber of the internal combustion engine, is provided with a rigid first ring configured to be circumferentially placed against the fuel injector. A rigid second ring is configured to be inserted into the receiving bore. An elastic intermediate ring, positioned between these rigid rings, is permanently joined to the rigid first ring and the rigid second ring.

15 Claims, 1 Drawing Sheet

COMPENSATING ELEMENT FOR A FUEL INJECTOR VALVE

FIELD OF THE INVENTION

The present invention relates to a compensating element for a fuel injector.

BACKGROUND INFORMATION

German Published Patent Application No. 197 35 665 describes a fuel injection system which has a compensating element made of a supporting body having a dome-shaped supporting surface. This compensating element supports a fuel injector in a receiving bore of a cylinder head. Since the fuel injector rests on the spherically shaped calotte surface by way of a supporting surface, the fuel injector can be mounted at an angle that deviates from the axis of the receiving bore by up to a certain amount, and can be pressed firmly into the receiving bore using appropriate means, e.g., a clamping shoe. This allows a simple adaptation to be made to the fuel supply lines. Tolerances arising in the manufacture and in the mounting of the fuel injectors can be compensated for.

It is disadvantageous, however, that the supporting body requires expensive manufacturing and that a precisely manufactured, spherical surface is needed. The rigid supporting body cannot be compressed, and thus no compensation in the axial direction of the receiving bore occurs. Moreover, tolerance can only be compensated with respect to the specified geometry of the spherical surface. A radial compensation movement purely with respect to the receiving bore is not possible.

A system described in German Published Patent Application No. 197 35 665, for forming the spherical surface on the cylinder head itself and thus, obviating a separate component part, has the additional disadvantage that the spherical surface requiring a high degree of accuracy must be formed in a bore, at the relatively large workpiece for the entire cylinder head. This has disadvantages from the standpoint of production engineering.

German Published Patent Application No. 197 35 665 describes an intermediate piece on an inlet side of a fuel injector, in order to compensate for tolerances with respect to the axes of the fuel injector and a fuel-outlet orifice of a fuel-distributor line. In this context, a nozzle body of the fuel injector is inserted into a receiving borehole of a cylinder head, and is held by suitable retaining means, e.g. a clamping shoe, which means that the position of the fuel-injector axis is preselected. A possible axial offset between the axis of the fuel injector and the axis of the fuel-outlet orifice of the fuel-distributor line is compensated for by tilting of the intermediate piece positioned between the axes. In each case, this intermediate piece is sealed by a sealing ring in a direction of the fuel-distributor line, as well as in a direction of the fuel injector.

It may be disadvantageous to have the additional expenditure associated with having several more components, and to have the additional number of connections to be sealed. Since the intermediate piece requires an increased overall height, it can only be designed to be relatively short. This results in the need for the intermediate piece to already be at a relatively large angle to the axes, even when the axial offset to be adjusted is small. However, in the case of bending, the seal of the sealing ring between the fuel injector and the intermediate piece, on one hand, and between the fuel-outlet orifice and the intermediate piece, on the other hand, is based only on the elasticity of the respective sealing ring. Therefore, there is the danger of the sealing rings not being uniformly compressed between the respective sealing surfaces, when the angle is too large. This can result in leakage.

A thermal protection sleeve is described in German Published Patent Application No. 197 43 103, which encircles a fuel injector at a nozzle body. The thermal protection sleeve is inserted into a stepped receiving borehole of a cylinder head of an internal combustion engine, and circumferentially surrounds an ejection-side nozzle body segment of a fuel injector inserted into the receiving borehole. One end of the thermal protection sleeve has a collar, which rests against a step of the receiving borehole. In addition, the ejection-side end of the thermal protection sleeve has a folded section, which renders a certain length of the sleeve double-layered. In this region, the sleeve is radially locked between the nozzle body and the bore in the cylinder head. Since a tapered segment of the thermal protection sleeve, against which a likewise tapering segment of the fuel injector rests, is adjacent to the double-layered segment in the direction of the fuel supply line of the fuel injector, a certain transfer of axial force from the nozzle body of the fuel injector to the thermal protection sleeve is possible.

However, this does not allow adjustment of the tolerances of the position of the fuel injector in the receiving borehole. Furthermore, the fuel injector rests against a beveled step of the receiving bore, thereby completely determining the axial position of the fuel injector.

SUMMARY

In contrast, an example embodiment of the compensating element according to the present invention may allow the fuel injector to be tilted with respect to the axis of the receiving bore, over a relatively large angular range, and may also allow a radial movement of the fuel injector from the center axis of the receiving bore. In addition, the compensating element of the present invention may be simple and inexpensive to manufacture. The compensating element transmits the axial force between the fuel injector and the receiving bore in the cylinder head, the receiving borehole supporting the fuel injector in opposition to the retention force holding it in place.

The retention force and position of the fuel injector may be able to be adjusted without difficulty, since the compensating element may yield in a flexible manner in the axial direction of the receiving bore and the increase in the retention force may be able to be regulated as a result of the compressibility of the intermediate ring, via the depth of insertion of the fuel injector into the receiving bore.

The use of a compensating element configured according to the present invention may allow relatively large manufacturing tolerances in the manufacture of the cylinder head and also in the manufacture of the fuel injector and the fuel-distributor line.

The first ring may have a conical surface. It may rest against a conical shoulder of the fuel injector, thereby centering and guiding the fuel injector in the first ring. The tolerance adjustment may occur in a reliable manner by elastic deformation of the intermediate ring, and not by a faulty position of the compensating element.

The first and second ring may be made of sheet-metal parts, which are inexpensive to manufacture.

An exemplary embodiment of the present invention is schematically illustrated in the drawings and explained in greater detail in the following description.

DETAILED DESCRIPTION

Figure 1:
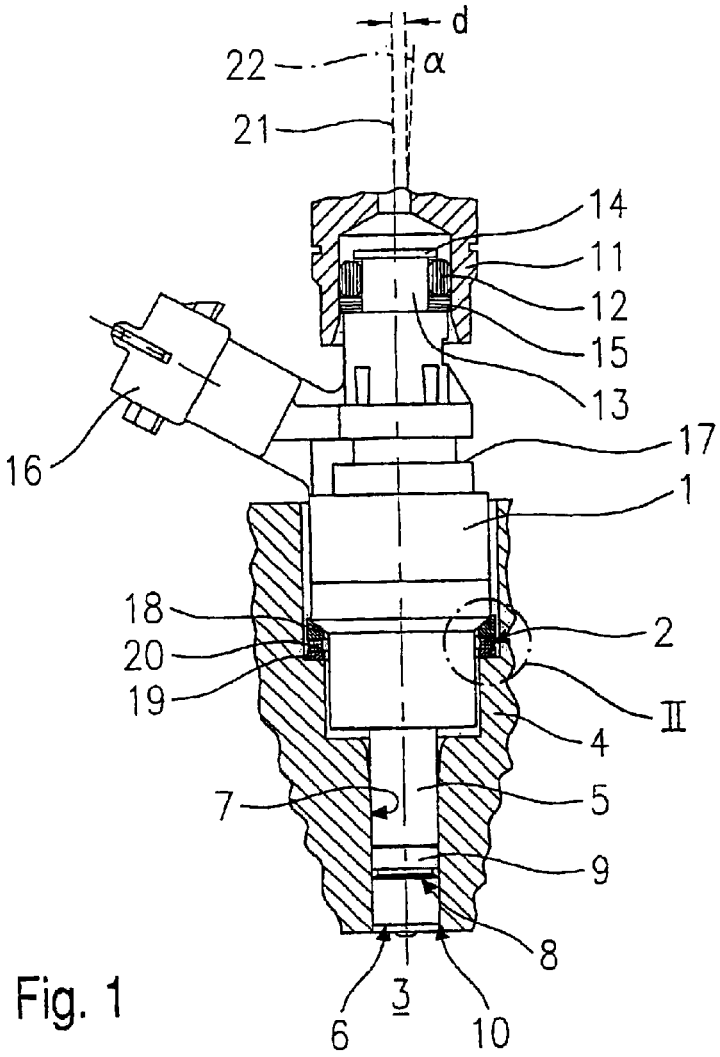
FIG. 1 is a cross-sectional view of a fuel injector inserted into a cylinder head and a compensating element according to an example embodiment of the present invention.

FIG. 1 illustrates a fuel injector 1 having a compensating element 2 according to the present invention. Fuel injector 1 is used for injecting fuel in the case of a mixture-compressing internal combustion engine having externally supplied ignition. Fuel injector is a high-pressure fuel injector for the direct injection of fuel into a combustion chamber 3 of the internal combustion engine, which is located beneath a cylinder head 4. However, compensating element 2 of the present invention may also be used in other cases.

Fuel injector 1 includes a nozzle body 5 having an ejection-side end 6, and is mounted in a receiving bore 7 of a cylinder head 4, a cross-sectional view of which is indirectly illustrated.

Furthermore, FIG. 1 illustrates a sealing ring 9 positioned in a groove 8 of nozzle body 5 on the side of the combustion chamber, which seals a ring gap 10 between nozzle body 5 and receiving bore 7, and is made of Teflon®, for example.

FIG. 1, in a cross-sectional view, also illustrates a fuel feed 11 on fuel injector 1, for instance, a fuel-distributor line, which is sealed from a connecting piece 13 of fuel injector 1 by a sealing ring 12. Sealing ring 12 is guided by a flange 14 of connecting piece 13 and a bearing ring 15.

A plug connector 16 is used to connect fuel injector 1 having electrical control and provided here by example, to an electrical control lead.

A holding-down clamp, which holds fuel injector 1 in receiving bore 7, presses down on a collar 17 at nozzle body 5 of fuel injector 1.

Compensating element 2 has a rigid first ring 18 and a rigid second ring 19 as well as an elastic intermediate ring 20, which, in the example embodiment, are permanently joined to each other by vulcanization of elastic intermediate ring 20, which is made of rubber. Other designs, using other elastic materials such as another elastomer or of Teflon®, or a bonding of elastic intermediate ring 20 to first ring 18 and second ring 19 are also possible.

To illustrate the compensating function of compensating element 2, a valve center axis 21 of fuel injector 1 is provided. Due to elastic deformation of elastic intermediate ring 20 and a thus possible adaptive movement of fuel injector 1 to the geometric position of fuel feed 11, it may deviate, both by a distance d and, additionally, also by an angle $\alpha$, from a bore center axis 22.

Figure 2:
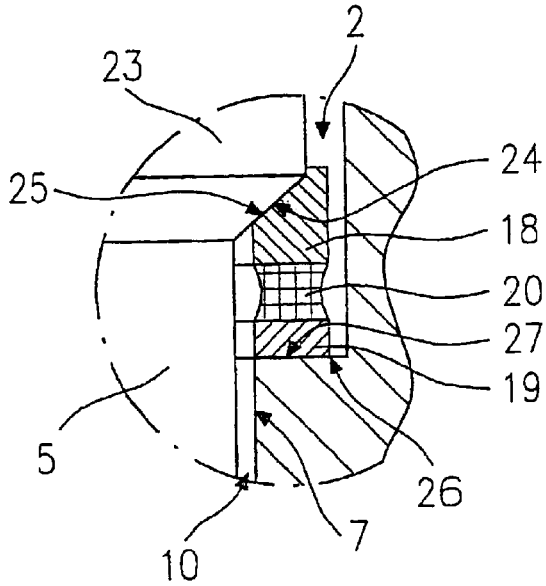
FIG. 2 is an enlarged view of detail II illustrated in FIG. 1.

FIG. 2 illustrates an enlarged view of cut-out portion II illustrated in FIG. 1. Illustrated in FIG. 2 are nozzle body 5, housing section 23 of fuel injector 1 having a larger diameter, and a conical shoulder 24 of fuel injector 1. Compensating element 2 is illustrated in a cross-sectional view.

Rigid first ring 18 has an inner conical surface 25 which abuts against conical shoulder 24 of fuel injector 1. Rigid second ring 19 has a flat annular surface 26, which rests against a step 27 of receiving bore 7. Elastic intermediate ring 20 permanently joins rigid first ring 18 to rigid second ring 19. A ring gap 10 is formed between nozzle body 5 and receiving bore 7. Intermediate ring 20, as well as second ring 19, have a substantially rectangular cross-section.

Fuel injector 1, through conical shoulder 24 and conical surface 25, may be centered at rigid first ring 18, and also may be able to transmit forces thereto that are radial with respect to valve center axis 21. When the clamping shoe is tightened, fuel injector 1 automatically adjusts to required tilting angle $\alpha$, due to stronger compression of elastic intermediate ring 20 on one side, and due to the force transmitted by fuel injector 1, automatically adjusts to the required distance d of a radial movement, so that fuel feed 11 is connected to fuel injector 1 in a strain-free manner.

In addition, a possible height difference may be compensated for by stronger compression of elastic intermediate ring 20 over an entire circumference.

Rigid first ring 18, such as with respect to its center point, is radially moveable relative to rigid second ring 19 with respect to its center point, by elastic deformation of elastic intermediate ring 20.

Rigid first ring 18, is able to be tilted, such as with respect to a center-point axis, relative to rigid second ring 19, with respect to a center-point axis formed thereby, by elastic deformation of elastic intermediate ring 20.

Elastic intermediate ring 20 of compensating element 2 may reduce a transmission of sound conducted through solids and oscillations as well as heat between cylinder head 4 and fuel injector 1.

What is claimed is:

1. A compensating element for a fuel injector insertable into a receiving bore of an internal combustion engine and configured for direct injection of fuel into a combustion chamber of the internal combustion engine, comprising:

a rigid first ring configured to be placed circumferentially against the fuel injector;

a rigid second ring configured to be inserted into the receiving bore; and an elastic intermediate ring permanently joined to the rigid first ring and to the rigid second ring and positioned between the first ring and the second ring;

wherein the rigid first ring has a conical surface configured to be placed against a conical shoulder of the fuel injector.

2. The compensating element according to claim 1, wherein the elastic intermediate ring is made of an elastomer, and the rigid first ring and the rigid second ring are made of metal.

3. The compensating element according to claim 2, wherein the rigid first ring and the rigid second ring are joined to the elastic intermediate ring by vulcanization.

4. The compensating element according to claim 1, wherein the rigid second ring has a flat annular surface configured to be placed against a step of the receiving bore.

5. The compensating element according to claim 1, wherein at least one of the rigid first ring and the rigid second ring are made of a stamped sheet-metal part.

6. A compensating element for a fuel injector insertable into a receiving bore of an internal combustion engine and configured for direct injection of fuel into a combustion chamber of the internal combustion engine, comprising:

a rigid first ring configured to be placed circumferentially against the fuel injector;

a rigid second ring configured to be inserted into the receiving bore; and an elastic intermediate ring permanently joined to the rigid first ring and to the rigid second ring and positioned between the first ring and the second ring;

wherein the rigid first ring with respect to a center point thereof is radially moveable relative to the rigid second ring with respect to a center point thereof by elastic deformation of the elastic intermediate ring.

7. The compensating element according to claim 6, wherein the elastic intermediate ring is made of an elastomer, and the rigid first ring and the rigid second ring are made of metal.

8. The compensating element according to claim 7, wherein the rigid first ring and the rigid second ring are joined to the elastic intermediate ring by vulcanization.

9. The compensating element according to claim 6, wherein the rigid second ring has a flat annular surface configured to be placed against a step of the receiving bore.

10. The compensating element according to claim 6, wherein at least one of the rigid first ring and the rigid second ring are made of a stamped sheet-metal part.

11. A compensating element for a fuel injector insertable into a receiving bore of an internal combustion engine and configured for direct injection of fuel into a combustion chamber of the internal combustion engine, comprising:

a rigid first ring configured to be placed circumferentially against the fuel injector;

a rigid second ring configured to be inserted into the receiving bore; and an elastic intermediate ring permanently joined to the rigid first ring and to the rigid second ring and positioned between the first ring and the second ring;

wherein the rigid first ring with respect to a center-point axis thereof is tiltable relative to the rigid second ring with respect to a center axis therethrough by elastic deformation of the elastic intermediate ring.

12. The compensating element according to claim 11, wherein the elastic intermediate ring is made of an elastomer, and the rigid first ring and the rigid second ring are made of metal.

13. The compensating element according to claim 12, wherein the rigid first ring and the rigid second ring are joined to the elastic intermediate ring by vulcanization.

14. The compensating element according to claim 11, wherein the rigid second ring has a flat annular surface configured to be placed against a step of the receiving bore.

15. The compensating element according to claim 11, wherein at least one of the rigid first ring and the rigid second ring are made of a stamped sheet-metal part.

* * * * *